US005684459A

United States Patent [19]

Liu et al.

[11] Patent Number: 5,684,459

[45] Date of Patent: Nov. 4, 1997

[54] CURVATURE-REDUCTION ANNEALING OF AMORPHOUS METAL ALLOY RIBBON

[75] Inventors: Nen-chin Liu, Parkland; Larry Speciale, Deerfield Beach, both of Fla.

[73] Assignee: Sensormatic Electronics Corporation, Deerfield, Fla.

[21] Appl. No.: 538,026

[22] Filed: Oct. 2, 1995

[51] Int. Cl.[6] ..... G08B 13/14

[52] U.S. Cl. ..... 340/572; 148/121

[58] Field of Search ..... 340/572, 551; 148/121

[56] References Cited

U.S. PATENT DOCUMENTS

| | | | |
|---|---|---|---|
| 4,437,907 | 3/1984 | Sato et al. | 148/108 |
| 4,475,962 | 10/1984 | Hayakawa et al. | 148/108 |
| 4,510,489 | 4/1985 | Anderson, III et al. | 340/572 |
| 4,744,838 | 5/1988 | Lin et al. | 148/121 X |
| 5,252,144 | 10/1993 | Martis | 148/121 |
| 5,469,140 | 11/1995 | Liu et al. | 340/551 |

FOREIGN PATENT DOCUMENTS

| | | | |
|---|---|---|---|
| 140824 | 8/1982 | Japan | 148/121 |
| 26317 | 2/1983 | Japan | 148/121 |
| 5837127 | 3/1983 | Japan | 148/108 |
| 166532 | 10/1983 | Japan | 148/121 |
| 5906360 | 1/1984 | Japan | 148/108 |
| 40503 | 3/1984 | Japan | 148/121 |
| 154332 | 8/1985 | Japan | 148/121 |
| 115618 | 5/1988 | Japan | 148/121 |
| 1731830 | 5/1992 | U.S.S.R. | 148/108 |

*Primary Examiner*—Thomas Mullen

*Attorney, Agent, or Firm*—Robin, Blecker, Daley and Driscoll

[57] ABSTRACT

A longitudinal curvature in an amorphous metal alloy ribbon is reduced by heat-treatment. While the heat-treatment occurs, the alloy ribbon is bent "backwards" against the longitudinal curvature, to reduce the amount of heat-treatment required. The process is carried out continuously by transporting the alloy ribbon from reel to reel, while wrapping the ribbon around a heated roller. Using a discrete strip cut from the alloy ribbon subjected to the curvature-reducing process, a magnetomechanical EAS marker is constructed that has a relatively low profile, while retaining desired magnetic properties.

31 Claims, 7 Drawing Sheets

CURVATURE-REDUCTION ANNEALING OF AMORPHOUS METAL ALLOY RIBBON

FIELD OF THE INVENTION

This invention relates to magnetomechanical markers used in electronic article surveillance (EAS) systems, and a method and apparatus for making the same.

BACKGROUND OF THE INVENTION

It is well known to provide electronic article surveillance systems to prevent or deter theft of merchandise from retail establishments. In a typical system, markers designed to interact with an electromagnetic or magnetic field placed at the store exit are secured to articles of merchandise. If a marker is brought into the field or "interrogation zone", the presence of the marker is detected and an alarm is generated. Some markers of this type are intended to be removed at the checkout counter upon payment for the merchandise. Other types of markers are deactivated upon checkout by a deactivation device which changes an electromagnetic or magnetic characteristic of the marker so that the marker will no longer be detectable at the interrogation zone.

One type of magnetic EAS system is referred to as a harmonic system because it is based on the principle that a magnetic material passing through an electromagnetic field having a selected frequency disturbs the field and produces harmonic perturbations of the selected frequency. The detection system is tuned to recognize certain harmonic frequencies and, if present, causes an alarm. The harmonic frequencies generated are a function of the degree of nonlinearity of the hysteresis loop of the magnetic material.

Another type of EAS system employs magnetomechanical markers that include a magnetostrictive element. For example, U.S. Pat. No. 4,510,489, issued to Anderson, et al., discloses a marker which includes a ribbon-shaped length of a magnetostrictive amorphous material contained in an elongated housing in proximity to a biasing magnetic element. The magnetostrictive element is sometimes referred to as an "active element" and the biasing element may be considered a "control element." The magnetostrictive element is fabricated such that it is resonant at a predetermined frequency when the biasing element has been magnetized to a certain level. At the interrogation zone, a suitable oscillator provides an a.c. magnetic field at the predetermined frequency, and the magnetostrictive element mechanically resonates at this frequency upon exposure to the field when the biasing element has been magnetized to a certain level. According to one technique disclosed in the Anderson, et al. patent, the marker has, in addition to the aforesaid resonant frequency, an "anti-resonant frequency" at which the stored mechanical energy resulting from magnetomechanical coupling is near zero. An interrogation circuit which provides the magnetic field at the interrogation zone is swept through a frequency range that includes the marker's resonant and anti-resonant frequencies, and receiving circuitry is provided at the interrogation zone to detect the marker's characteristic signature by detecting a peak transmitted energy level which occurs at the resonant frequency, and a valley level at the anti-resonant frequency.

In another surveillance system proposed by Anderson, et al., a magnetomechanical marker is used with an interrogation frequency that is not swept, but rather remains at the marker's resonant frequency. The interrogation field at this frequency is provided in pulses or bursts. When a marker is present in the interrogation field, its active element is excited by each burst (assuming that the control element has been suitably magnetized), and after each burst is over, the active element undergoes a damped mechanical oscillation, known as "ring down". The resulting signal radiated by the marker is detected by detecting circuitry which is synchronized with the interrogation circuit and arranged to be active during the quiet periods after bursts. Magnetomechanical EAS systems of this pulsed-field type are sold by the assignee of this application under the brand name "Ultra*Max" and are in widespread use.

The disclosure of the aforesaid U.S. Pat. No. 4,510,489 is incorporated herein by reference.

In a commonly used magnetomechanical marker, the active element is formed of an amorphous iron-nickel alloy known as Metglas® 2826MB (available from Allied Signal Inc., Morris Township, N.J.) and having the composition $Fe_{40}Ni_{38}Mo_4B_{18}$ (by atomic percent). The material is formed by casting on a cooled wheel to produce a thin continuous ribbon that is about one-half inch wide. The continuous ribbon is cut into segments of about 1.5 inches in length to form active elements for magnetomechanical markers.

FIG. 1 is a somewhat schematic side view of an active element 20 formed of the Metglas 2826MB material, resting on a flat surface represented by a dashed line 22. The element 20 has a length L, of about 1.5 inches and exhibits a curvature along its length L such that a central portion of the element 20 forms a "crown" displaced by a distance D above the surface 22. A typical measured value of the curvature distance D is about 0.033 inches (it being understood that the curvature in the element 20 has been exaggerated in the drawing for clarity of presentation), but the casting process is inherently variable and may result in 1.5 inch cut-strips exhibiting a curvature distance D in excess of 0.040 inch or as small as 0.005 inch. The vertical distance D may be divided by the length L of the element 20 to produce a ratio of longitudinal curvature to length, which typically exceeds 2% (0.033/1.5=0.022).

FIG. 2 is a somewhat schematic side view, in cross-section, of a marker 24 fabricated in accordance with the prior art and incorporating an active element 20. The marker 24 includes a housing 26 which encloses the active element 20. The housing 26 is dimensioned so that the active element 20 is free to mechanically resonate in response to an interrogation field signal.

A bias element is typically adhered to an outer surface of either the bottom or the top wall of the housing 26. Alternatively, the bias element may be sandwiched between two layers of housing material making up a top wall or a bottom wall. A dashed line 28 in FIG. 2 represents a bias element adhered to a top wall of the housing 26.

Because of the curvature exhibited by the active element 20, and the need to allow the active element room for mechanical vibration in response to EAS interrogation signals, the housing 26 is formed with a significant thickness or height dimension H. In particular, known magnetomechanical markers have an overall thickness or height of at least about 0.065 inches, and a total height of 0.080 inch is common. The thickness characteristic of conventional magnetomechanical markers sometimes makes it difficult or inconvenient to apply the markers to articles of merchandise desired to be protected by EAS systems.

In co-pending U.S. patent application Ser. No. 08/269,651, now U.S. Pat. No. 5,469,140 (which has a common inventor and common assignee with the present application), there was disclosed a technique in which pre-cut strips of an amorphous iron-cobalt alloy are annealed in the presence of a saturating transverse magnetic field to produce active elements for magnetomechanical markers. One advantage of the annealed iron-cobalt active elements is that they have a relatively smooth and linear hysteresis loop characteristic and so are unlikely to produce false alarms upon exposure to harmonic EAS systems. Another advantage of the iron-cobalt active elements, as described in said '651 patent application, is that the annealing may be performed on a flat surface so as to minimize or eliminate any longitudinal curvature, making possible a low-profile magnetomechanical marker. The disclosure of the said '651 application is incorporated herein by reference.

The iron-cobalt active elements described in the '651 application can also be formed using a continuous annealing process, in which a ribbon is transported from reel to reel through an annealing oven and then cut into discrete strips. This continuous process is described in co-pending application Ser. No. 08/420,757, which has the same inventors as, and a common assignee with, the present application.

Although the aforesaid co-pending applications disclose techniques for realizing low-profile magnetomechanical markers which incorporate iron-cobalt alloys, it would also be desirable to produce a low-profile marker utilizing an active element formed of the conventional iron-nickel material.

It has been attempted to cast the iron-nickel material on a larger-diameter wheel so as to reduce the cast-in curvature of the resulting ribbon. However, these attempts have in general produced material that provides a substantially lower output signal amplitude than material produced by the conventional technique.

It has also been attempted to heat-treat the cast ribbon while pressing the ribbon between two flat plates in order to reduce the curvature in the ribbon. Although the curvature is reduced by this process, the desirable magnetic properties of the material are also reduced, so that the resulting active elements again fail to provide an output signal of adequate amplitude.

OBJECTS AND SUMMARY OF THE INVENTION

It is accordingly an object of the invention to provide a technique for reducing the longitudinal curvature of an iron-nickel metal alloy ribbon suitable for forming active elements for use in magnetomechanical markers, without substantially affecting desirable magnetic properties of the material.

It is a further object of the invention to provide a low-profile magnetomechanical marker utilizing an active element of conventional composition.

According to an aspect of the invention, there is provided a method of forming a magnetostrictive element for use in a magnetomechanical electronic article surveillance marker, including the steps of providing a continuous strip of an amorphous metal alloy, heat-treating the continuous amorphous alloy strip at a heating location while continuously transporting the strip past the heating location, and, cutting the heat-treated strip into discrete strips each having a predetermined length.

Further in accordance with this aspect of the invention, a curvature is applied to the continuous alloy strip in a longitudinal direction of the strip during the heat-treating step, and at an orientation opposite to an orientation of longitudinal curvature exhibited by the strip prior to the heat-treating step. The heat-treating and application of the curvature may be performed simultaneously by wrapping the strip in a suitable manner around a heated roller. The heat-treating is preferably performed at a temperature of at least 300° C. and the continuous strip may be transported from a supply reel to a take-up reel using a capstan and pinch roller arrangement.

According to another aspect of the invention, there is provided a magnetostrictive element for use in a magnetomechanical electronic article surveillance marker, formed by heat-treating a continuous strip of an amorphous metal alloy while applying a curvature to the strip in a longitudinal direction of the strip, and then cutting the heat-treated continuous strip into discrete strips. Further in accordance with this aspect of the invention, the application of the curvature is performed so as to reduce a degree of longitudinal curvature exhibited by the continuous strip prior to the heat-treatment.

In accordance with still a further aspect of the invention, there is provided a marker for use in a magnetomechanical electronic article surveillance system, including an active element such as is described in the foregoing paragraph.

According to still a further aspect of the invention, there is provided a magnetomechanical electronic article surveillance system, including generating circuitry for generating an electromagnetic field alternating at a selected frequency in an interrogation zone, and including an interrogation coil; a marker secured to an article appointed for passage through the interrogation zone, and including an amorphous magnetostrictive element formed by heat-treating a continuous strip of an amorphous metal alloy while applying a curvature to the strip in a longitudinal direction of the strip, and then cutting the heat-treated continuous strip into discrete strips, the marker also including a biasing element located adjacent to the magnetostrictive element, the biasing element being magnetically biased to cause the magnetostrictive element to be mechanically resonant when exposed to the alternating field; and detecting circuitry for detecting the mechanical resonance of the magnetostrictive element.

According to still a further aspect of the invention, there is provided a marker for use in a magnetomechanical electronic article surveillance system, including a discrete amorphous strip essentially having the composition $Fe_{40}Ni_{38}Mo_4B_{38}$, the marker having an overall thickness of less than 0.065 inches.

According to yet a further aspect of the invention, there is provided a method of reducing a degree of longitudinal curvature in an amorphous metal alloy strip having a longitudinal axis, including the steps of heat-treating the amorphous metal alloy strip, and, during the heat-treating step, also applying a curvature to the alloy strip along the longitudinal axis of the strip and at an orientation opposite to a longitudinal curvature exhibited by the strip prior to the heat-treating step. Further in accordance with the latter aspect of the invention, the amorphous metal alloy strip may be a continuous ribbon, and the heat-treating and curvature-applying steps may be performed while transporting the continuous strip from a supply reel to a take-up reel.

DESCRIPTION OF PREFERRED EMBODIMENTS

There will now be described, with reference to FIGS. 3A and 3B, a method and processing apparatus, provided in accordance with the invention, for forming the active elements of magnetomechanical EAS markers from a continuous ribbon of amorphous metal alloy.

Figure 1:
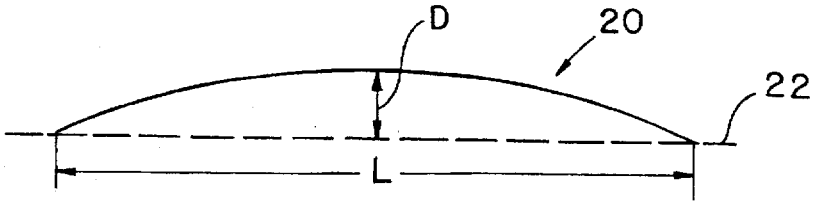
FIG. 1 (PRIOR ART)
FIG. 1 is a schematic side view of an active element, provided in accordance with the prior art, for use in a magnetomechanical marker.
Figure 2:
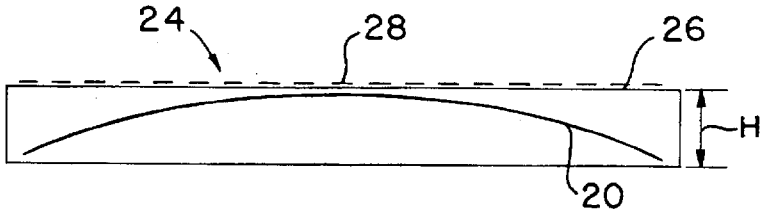
FIG. 2 (PRIOR ART)
FIG. 2 is a schematic cross-sectional side view of a magnetomechanical marker provided in accordance with the prior art, and including the active element of FIG. 1.

The processing apparatus is generally indicated by reference numeral 30. The apparatus 30 processes a continuous ribbon 32 of the above-mentioned Metglas 2826MB material so as to reduce or eliminate the longitudinal curvature described in connection with FIG. 1. The processing apparatus includes a heated roller 34, a supply reel 36, from which the alloy ribbon 32 is unwound and transported to the heated roller 34, and a take-up reel 38, on which the ribbon 32 is wound after being transported from the roller 34. A guide roller 37 defines a portion of the path of the ribbon from the supply reel 36 and the heated roller 34. An enclosure 39 is provided around the heated roller 34 to retain in the vicinity of the roller 34 heat radiated from the roller 34. Slots 41 are formed in the enclosure 39 to permit entrance and egress by the ribbon 32. The ribbon 28 is engaged between a capstan 40 and a pinch roller 42, which are positioned between the heated roller 34 and the take-up reel 38. The capstan 40, in cooperation with the pinch roller 42, draws the ribbon along its path from the supply reel 36 to the heated roller 34 and then toward the take-up reel 38. It should be understood that motors (not shown) are respectively provided for driving the capstan 40 and reels 36 and 38. Control of the motors may be by a human operator or by suitable control mechanisms.

The ribbon 32 is fed from the supply reel 36 at a rate such that a loop 43 is formed in the ribbon upstream from the guide roller 37 and heated roller 34. The weight of the ribbon in the loop 43 applies tension to the portion of the ribbon at the roller 34 so as to maintain the ribbon in contact with the surface of the roller 34.

Figure 3A:
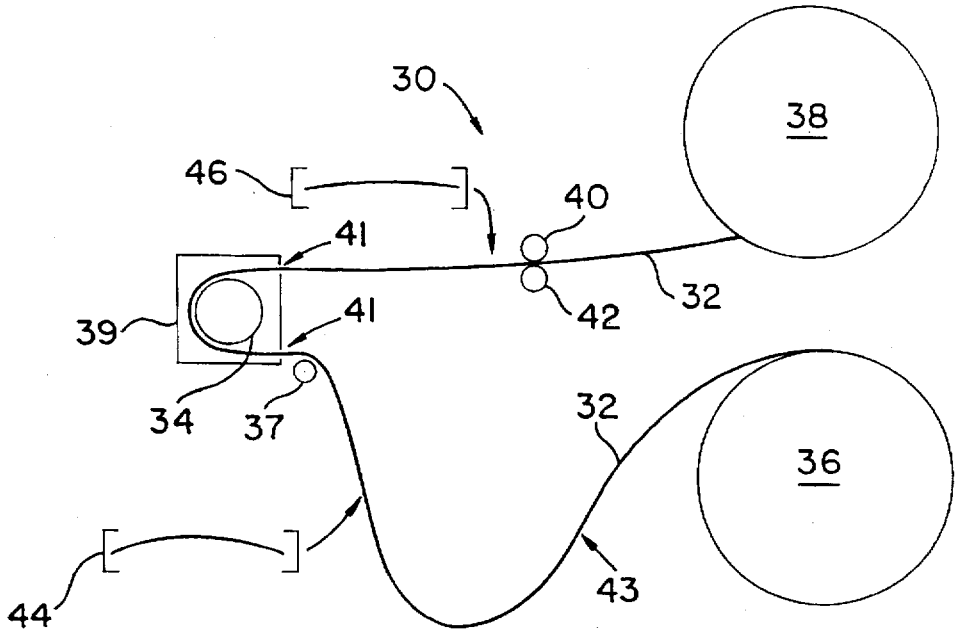
FIG. 3A is a schematic side view representation of a processing apparatus provided in accordance with the invention.
Figure 3B:
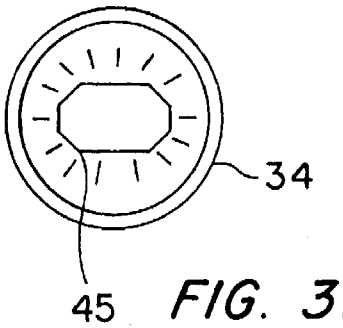
FIG. 3B is a schematic cross-sectional side view of a heated roller which is part of the apparatus of FIG. 3A.

Additional details of the heated roller 34 are shown in FIG. 3B. The roller 34 is preferably formed as a hollow cylinder of, for example, non-magnetic stainless steel or aluminum. A heating element 45 is provided inside the roller 34 to maintain the roller 34 at a desired temperature. Although the roller 34 may be mounted for rotation, in a preferred embodiment the roller 34 is fixedly mounted (by mounting means which are not shown) and the ribbon is allowed to slide on the surface of the roller 34.

Referring again to FIG. 3A, the alloy ribbon 32 is unwound from the supply reel 36 and presented to the heated roller 34 with the cast-in longitudinal curvature of the ribbon 32 oriented as illustrated at 44 in FIG. 3A. The ribbon 32 is then wrapped around the periphery of the roller 34 so that the ribbon 32 is "bent backwards" against the cast-in longitudinal curvature. In other words, a longitudinal curvature is applied to the ribbon 32 at the roller 34 with an orientation opposite to the orientation of the cast-in longitudinal curvature of the ribbon. This "backward bending" of the ribbon 32, together with the direct heating of the ribbon 32 by the roller 34, relieves at least some of the cast-in stress which had caused the longitudinal curvature, resulting in a reduced degree of curvature, as illustrated at 46 in FIG. 3A.

The ribbon 32 is about 12.7 mm wide, and is cut into discrete strips of about 37.44 mm in length after curvature-reduction processing by the apparatus shown in FIG. 3A. The heated roller 34, in a preferred embodiment of the apparatus, has a diameter of about 35.18 mm (1,385 inches) and is maintained at a temperature in the range of about 300° C. to about 375° C. The annealing time can be defined as the length of time that a point along the ribbon 32 remains in contact with the surface of the roller 34. Accordingly, the annealing time is a function of the speed at which the ribbon 32 is transported, the diameter of the roller 34, and the proportion of the circumference of the roller (wrapping angle) which comes into contact with the ribbon 32. In a preferred embodiment of the apparatus, a wrapping angle of about 180° is maintained, although a smaller or larger wrapping angle is contemplated. According to preferred methods of operating the apparatus, the annealing time is within a range of about 0.5 to 4.5 seconds.

It is also contemplated to provide a heated roller 34 that has a smaller or larger diameter than the preferred diameter of 35.18 mm. A roller 34 having a smaller diameter provides a greater degree of bending, but less effective heating of the ribbon 32. Correspondingly, a roller 34 with a larger diameter provides more effective heating of the ribbon 32, but a smaller degree of bending.

Figure 4:
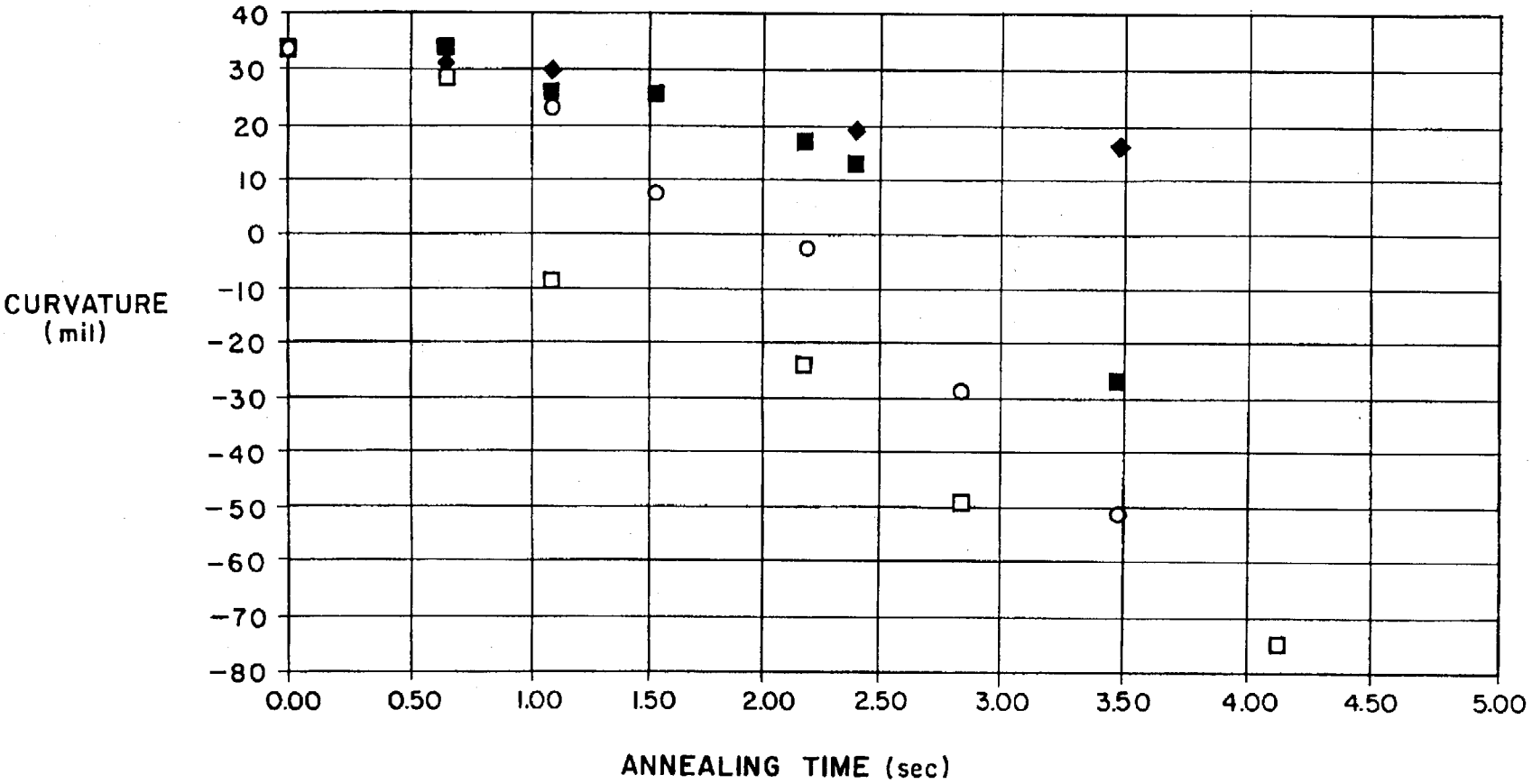
FIG. 4 is a graphical representation of reductions in curvature in an active element for a magnetomechanical marker, obtained by operating the processing apparatus of FIG. 3A at various temperatures and with various annealing time periods.

As indicated in FIG. 4, greater reductions in the cast-in curvature of the amorphous alloy material are obtained either with increasing annealing time or with increasing annealing temperature. In FIG. 4, the solid diamonds indicate results obtained with an annealing temperature of 300° C., the solid rectangles indicate results obtained at a temperature of 325°, the shaded circles indicate results obtained at 350°, and the open rectangles indicate results obtained at 375°. With respect to each one of those annealing temperatures, it is noted that increasing the annealing time increased the effectiveness of the curvature reduction, even to the point of inducing a curvature of an opposite orientation to the cast-in curvature when the annealing is performed at higher temperatures and relatively long times. For example, it will be observed that an essentially flat ribbon (nearly zero curvature) can be obtained by annealing at 350°

C. for about 2.2 seconds. However, a factor that must be taken into consideration in applying the curvature-reduction process described above is that the annealing may have an adverse effect upon the magnetic characteristics of the material.

Figure 5:
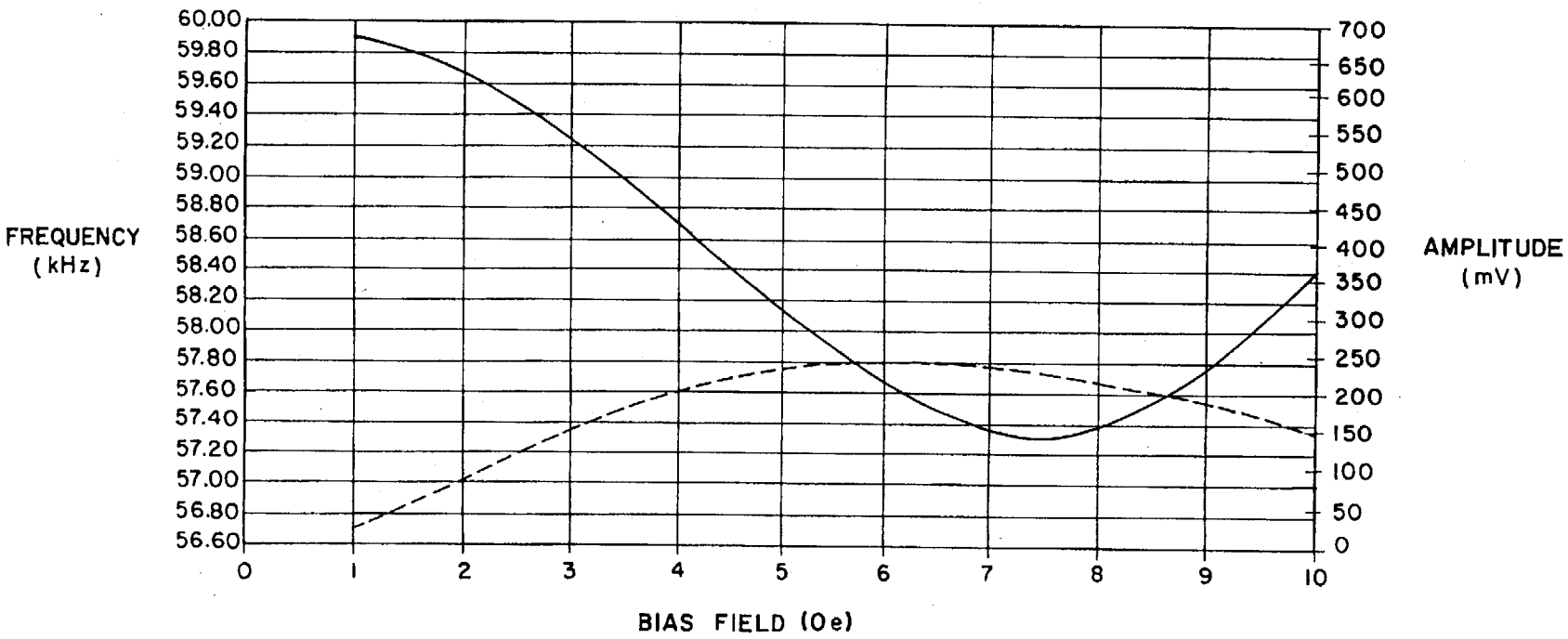
FIG. 5 (PRIOR ART)
FIG. 5 is a graphical representation of variations in resonant frequency and output signal amplitude exhibited by the prior art active element of FIG. 1 in response to changes in biasing magnetic field.

FIG. 5 graphically illustrates magnetic characteristics of the conventional as-cast Metglas 2826MB material. In FIG. 5, the solid curve indicates how the resonant frequency of the iron-nickel active element varies as a function of the applied bias field. The dashed-line curve indicates variation in output signal amplitude as a function of variations in the bias field. The amplitude levels shown in FIG. 5 are "Al" levels, i.e., the signal level obtained 1 millisecond after the end of the interrogation signal pulse in the above-described pulsed-field magnetomechanical system.

One important characteristic of the active element is the "frequency well depth", which is measured as the shift in resonant frequency from the minimum resonant frequency (about 57.3 kHz at about 7.5 Oe bias field) to the resonant frequency at a 1 Oe bias field. Since the resonant frequency at 1 Oe for the as-cast material is about 59.9 kHz, the frequency well depth for the as-cast material is about 2.6 kHz. Sufficient frequency well depth is required, because it is necessary to have enough resonant frequency shift by degaussing the control element in order to deactivate the marker.

It is also desirable to have a "ring down" signal that is at a high amplitude. Typically, the effective bias field in a magnetomechanical marker is about 5.5 Oe, and, as indicated in FIG. 5, the resulting Al ring down signal is at around 250 mV.

Figure 6:
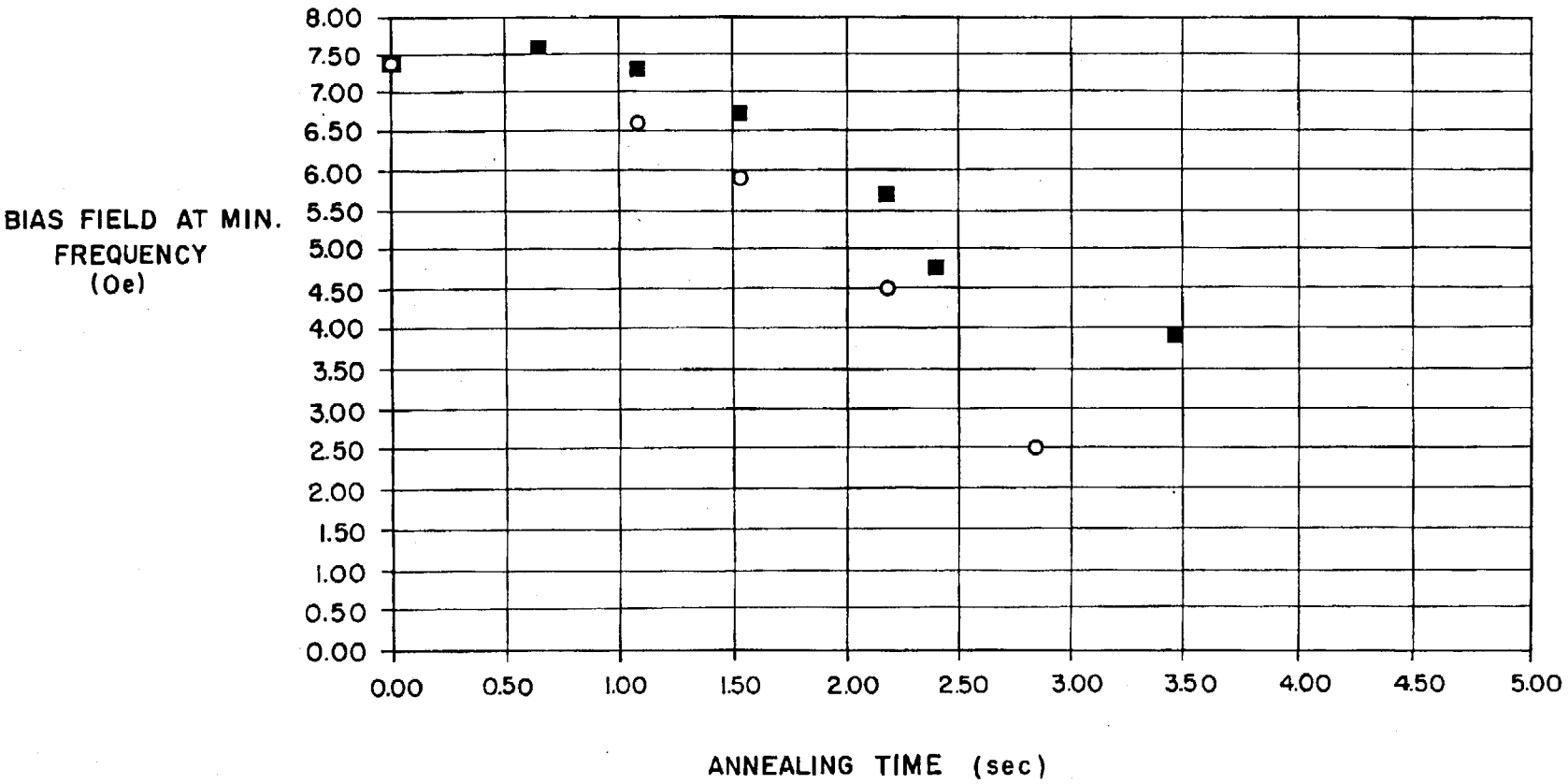
FIG. 6 is a graphical representation of various values of a bias field amplitude required to minimize resonant frequency for materials obtained in accordance with various combinations of time and temperature parameters in operation of the processing apparatus of FIG. 3A.

FIG. 6 illustrates how the curvature-reduction annealing process of the present invention reduces the bias field at which the minimum resonant frequency is obtained, with greater reductions in the bias field at minimum frequency occurring as annealing time is increased. In FIG. 6, the solid rectangles indicate results obtained at an annealing temperature of 325° C., and the shaded circles indicate results obtained at 350°. It is desirable to provide the marker with a bias field corresponding to the minimum resonant frequency, or with a bias field close in value to the minimum-frequency bias field, so as to minimize variations in resonant frequency caused by the varying effects of the earth's magnetic field on the effective bias experienced by the active element.

Figure 7:
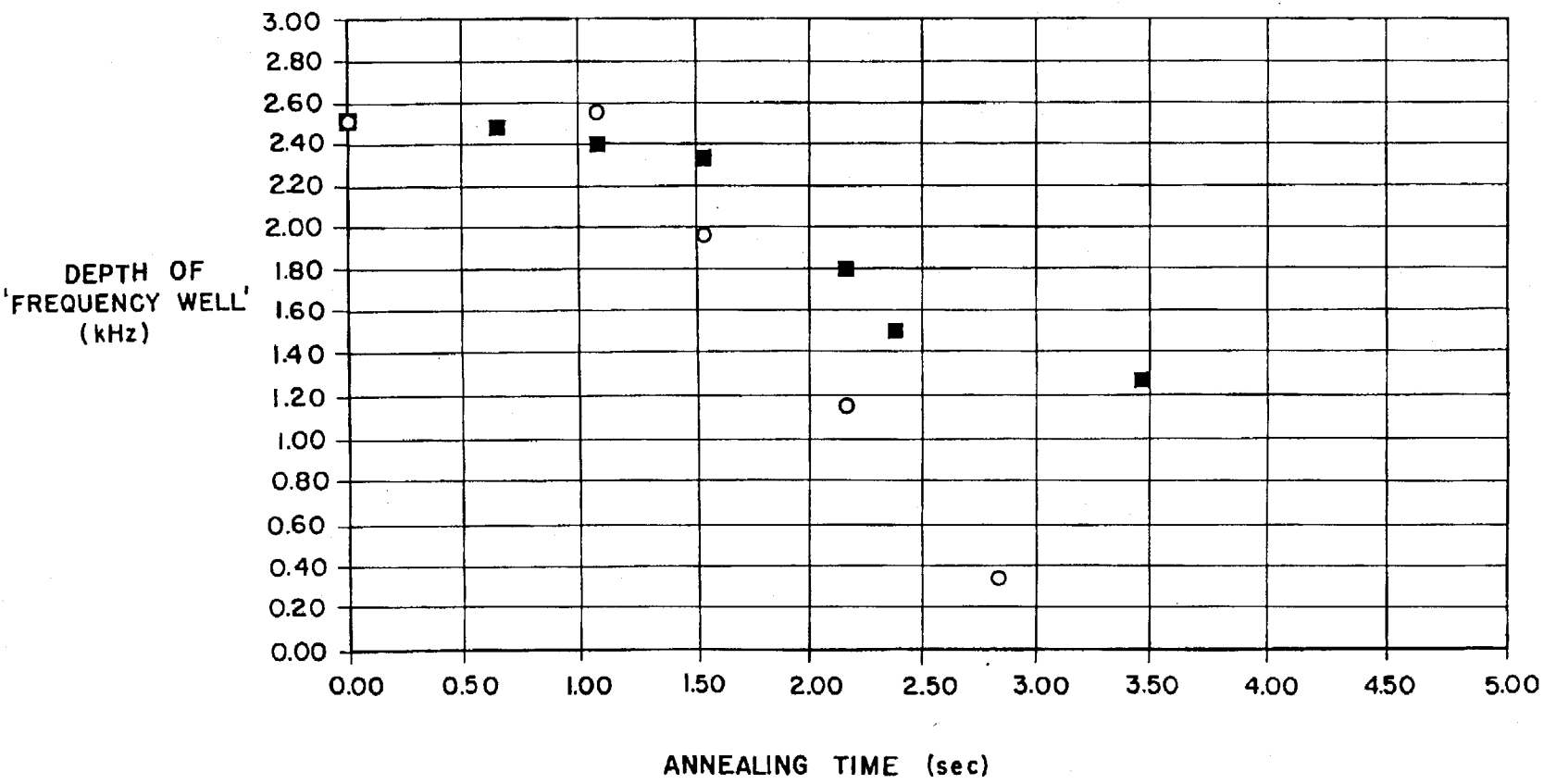
FIG. 7 is a graphical representation of a frequency well characteristic of materials obtained in accordance with various combinations of time and temperature parameters used in operation of the processing apparatus of FIG. 3A.

As shown in FIG. 7, the depth of the frequency well is reduced by the curvature-reduction annealing process. Again, solid rectangles indicate results obtained with an annealing temperature of 325° C., and the shaded circles indicate results obtained at 350° C.

Figure 8:
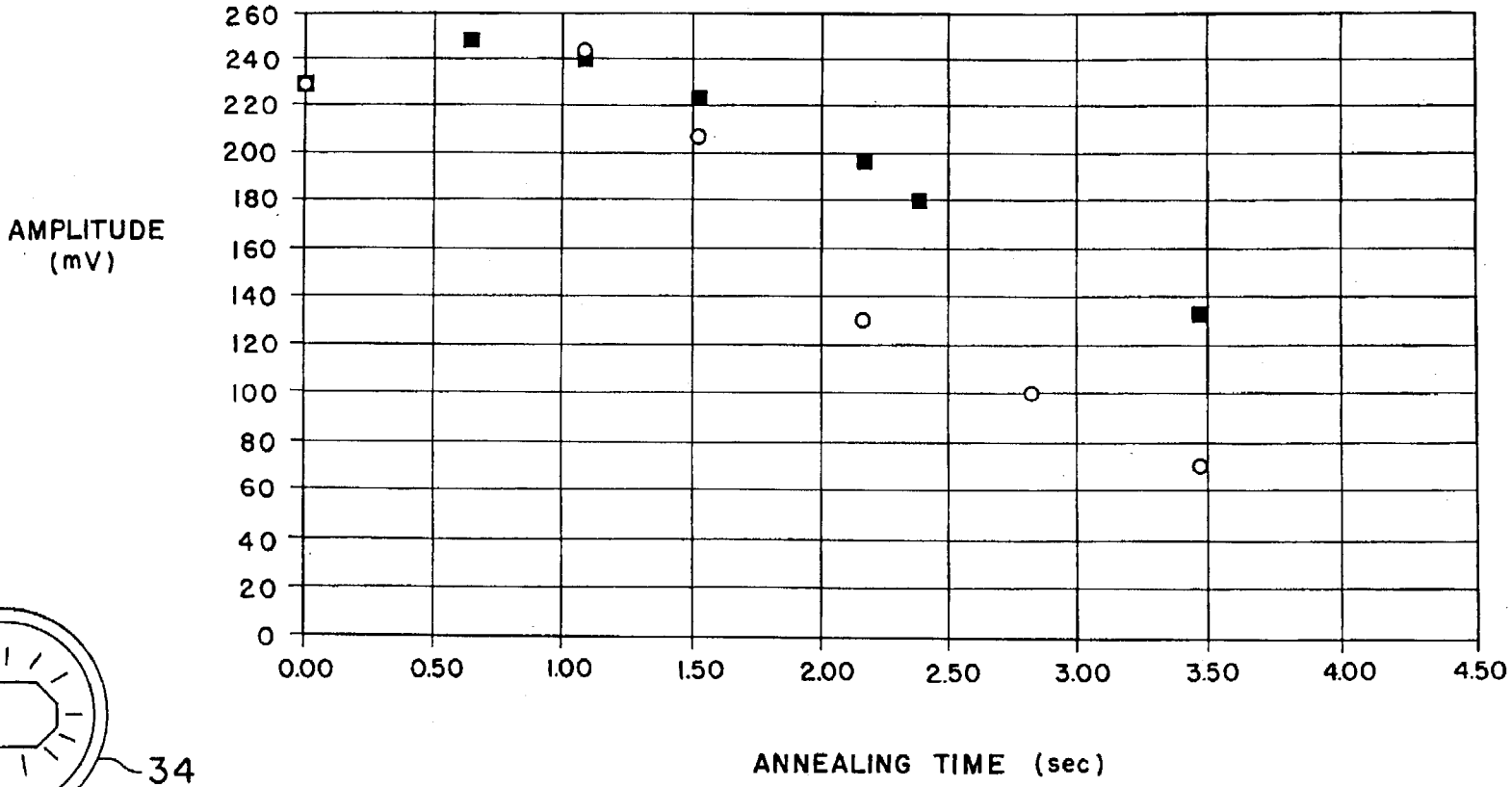
FIG. 8 is a graphical representation of respective output amplitude characteristics of materials obtained using various combinations of time and temperature parameters in operating the processing apparatus of FIG. 3A.

FIG. 8, in turn, illustrates the adverse effect of annealing on ring-down signal amplitude, with the solid squares and shaded circles again respectively indicating results obtained at 325° C. and 350° C., in respect to the Al ring down amplitude.

In view of the undesirable effect on magnetic characteristics resulting from the curvature-reduction process, it is advisable to accept a compromise between complete curvature reduction and minimal effects upon magnetic characteristics. A suitable set of annealing parameters, with the 35.18 mm heated roller, was found to be 350° C. for 1.5 seconds, which yields a curvature distance (D) of about 0.010 inches (10 mils) for a 1.5 inch cut-strip, without an excessive change in frequency well depth, or ring-down signal amplitude. With these parameters, then, a ratio of longitudinal curvature to length of less than 0.7% was obtained. By using the iron-nickel alloy which was subjected to curvature-reduction in accordance with the invention, a lower profile marker can be constructed, having an overall thickness of about 0.055 to 0.037 inches. These markers exhibit an Al ring down amplitude of about 200 mV, with a bias field at minimum resonant frequency of about 5.9 Oe and a frequency well depth of about 1.95 kHz.

Figure 9:
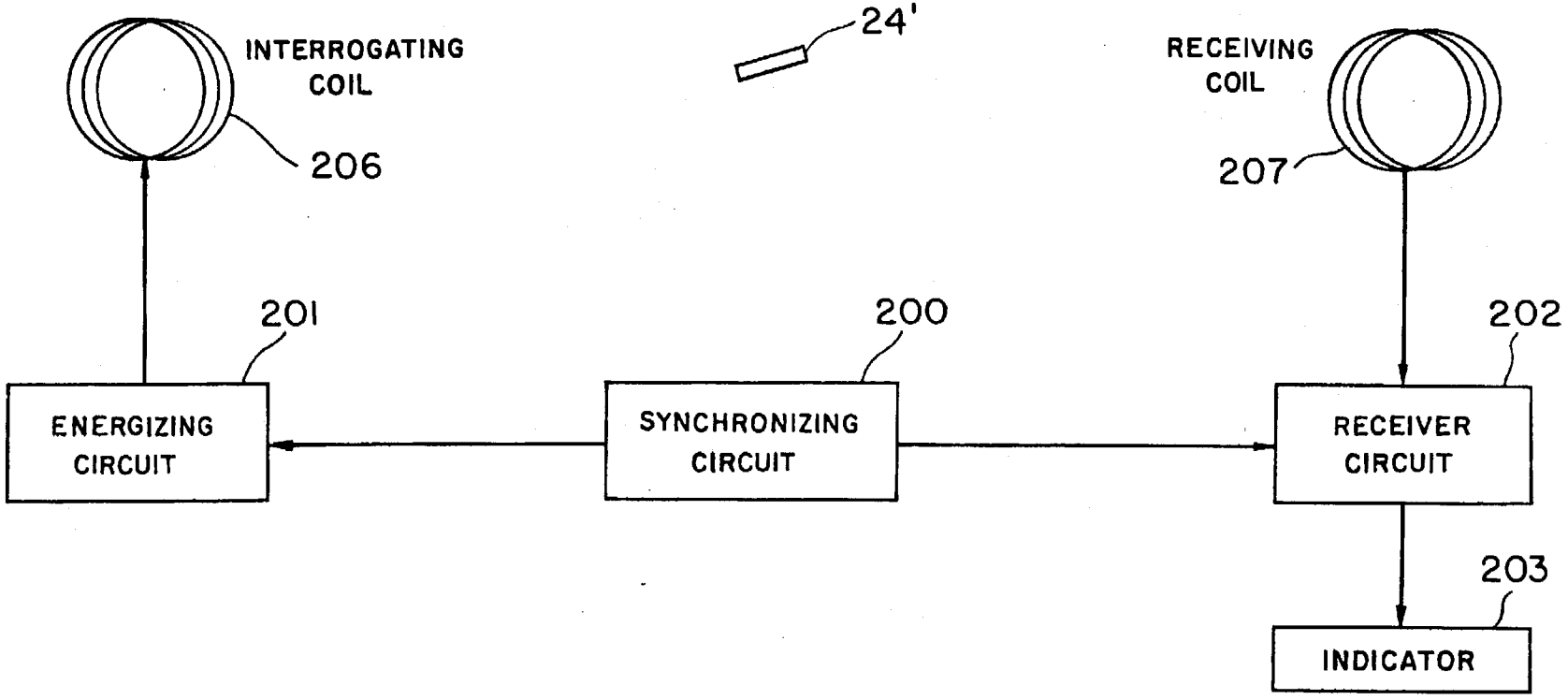
FIG. 9 is a schematic block diagram of an electronic article surveillance system which uses a magnetomechanical marker incorporating an active element formed in accordance with the invention.

FIG. 9 illustrates a pulsed-interrogation EAS system which uses a magnetomechanical marker 24' fabricated, in accordance with the invention, using an iron-nickel active element which has been subjected to the above-described curvature-reduction process.

The system shown in FIG. 9 includes a synchronizing circuit 200 which controls the operation of an energizing circuit 201 and a receiving circuit 202. The synchronizing circuit 200 sends a synchronizing gate pulse to the energizing circuit 201, and the synchronizing gate pulse activates the energizing circuit 201. Upon being activated, the energizing circuit 201 generates and sends an interrogation signal to interrogating coil 206 for the duration of the synchronizing pulse. In response to the interrogation signal, the interrogating coil 206 generates an interrogating magnetic field, which, in turn, excites the active element of the marker 24' into mechanical resonance.

Upon completion of the interrogation signal pulse, the synchronizing circuit 200 sends a gate pulse to the receiver circuit 202, and the latter gate pulse activates the circuit 202. During the period that the circuit 202 is activated, and if a marker is present in the interrogating magnetic field, such marker will generate in the receiver coil 207 a signal at the frequency of mechanical resonance of the marker. This signal is sensed by the receiver 202, which responds to the sensed signal by generating a signal to an indicator 203 to generate an alarm or the like. In short, the receiver circuit 202 is synchronized with the energizing circuit 201 so that the receiver circuit 202 is only active during quiet periods between the pulses of the pulsed interrogation field.

The curvature reduction apparatus illustrated in FIG. 3A was described as including a heated roller 34 provided as a hollow cylinder for heating the alloy ribbon by direct contact therewith. However, it is contemplated to provide a curved heating surface, for heating and bending "backward" the allow ribbon, in the form of a half-round fixture or a fixture in another curved shape. It could also be contemplated to apply a curvature-reduction treatment to discrete strips cut from the alloy ribbon as-cast, by bending the discrete strips backward while heating in an oven or the like. However, it is believed that such a process would not provide sufficient curvature reduction without also causing excessive deterioration in the magnetic properties of the cut strips.

Various other changes in the foregoing markers and modifications in the described practices may be introduced without departing from the invention. The particularly preferred embodiments of the invention are thus intended in an illustrative and not limiting sense. The true spirit and scope of the invention is set forth in the following claims.

What is claimed is:

1. A method of forming magnetostrictive elements for use in a magnetomechanical electronic article surveillance marker, comprising the steps of:

providing a continuous strip of an amorphous metal alloy;

heat-treating the continuous amorphous alloy strip at a heating location while continuously transporting the strip past the heating location;

applying a curvature to the continuous amorphous alloy strip, said curvature being applied by wrapping said strip around a curved element at said heating location; and cutting the heat-treated strip into discrete strips each having a predetermined length.

2. A method according to claim 1, wherein said curvature is applied to the continuous amorphous alloy strip in a longitudinal direction of the strip.

3. A method according to claim 2, wherein said steps of heat-treating the continuous amorphous alloy strip and applying the curvature thereto are performed by wrapping the strip around a heated roller.

4. A method according to claim 2, wherein the curvature is applied to the strip at an orientation opposite to an orientation of longitudinal curvature exhibited by the strip prior to said heat-treating step.

5. A method according to claim 1, wherein the continuous strip comprises an alloy of iron, nickel, molybdenum and boron.

6. A method according to claim 5, wherein the continuous strip essentially has the composition $Fe_{40}Ni_{38}Mo_4B_{18}$.

7. A method according to claim 1, wherein said heat-treating step is performed at a temperature of at least 300° C.

8. An apparatus for heat-treating a continuous strip of an amorphous metal alloy, comprising:

a curved element around which the continuous amorphous alloy strip is wrapped;

heating means for applying heat to the continuous amorphous alloy strip at the curved element; and transport means for continuously transporting the strip along a path past said heating means.

9. An apparatus according to claim 8, wherein said curved element is positioned relative to said path so as to apply a curvature to the continuous amorphous alloy strip in a longitudinal direction of the strip.

10. An apparatus according to claim 9, wherein said curved element is a heated roller.

11. An apparatus according to claim 8, further comprising:

a supply reel, from which the continuous strip is transported towards said heating means; and a take-up reel, towards which the continuous strip is transported from said heating means.

12. An apparatus according to claim 11, wherein said transport means includes a capstan and a pinch roller, both interposed between said heating means and said take-up reel, the continuous strip being engaged between said capstan and said pinch roller for being driven by said capstan towards said take-up reel.

13. A magnetostrictive element for use in a magnetomechanical electronic article surveillance marker, formed by heat-treating a continuous strip of an amorphous metal alloy at a curved element around which the strip is wrapped, and then cutting the heat-treated continuous strip into discrete strips.

14. A magnetostrictive element according to claim 13, wherein said heat-treatment is performed so as to reduce a degree of longitudinal curvature exhibited by the continuous strip prior to said heat-treatment.

15. A magnetostrictive element according to claim 13, comprising an alloy of iron, nickel, molybdenum and boron.

16. A magnetostrictive element according to claim 15, essentially having the composition $Fe_{40}Ni_{38}Mo_4B_{38}$.

17. A marker for use in a magnetomechanical electronic article surveillance system, comprising a discrete amorphous magnetostrictive strip formed by heat-treating a continuous strip of an amorphous metal alloy at a curved element around which the continuous strip is wrapped and then cutting the heat-treated continuous strip.

18. A marker according to claim 17, wherein said heat-treatment is performed so as to reduce a degree of longitudinal curvature exhibited by the continuous strip prior to said heat-treatment.

19. A marker according to claim 17, wherein said discrete amorphous magnetostrictive strip comprises an alloy of iron, nickel, molybdenum and boron.

20. A marker according to claim 17, wherein said discrete amorphous magnetostrictive strip essentially has the composition $Fe_{40}Ni_{38}Mo_4B_{18}$.

21. A magnetomechanical electronic article surveillance system comprising:

(a) generating means for generating an electromagnetic field alternating at a selected frequency in an interrogation zone, said generating means including an interrogation coil;

(b) a marker secured to an article appointed for passage through said interrogation zone, said marker including an amorphous magnetostrictive element formed by heat-treating a continuous strip of an amorphous metal alloy at a curved element around which the strip is wrapped, and then cutting the heat-treated continuous strip into discrete strips, said marker also including a biasing element located adjacent to said magnetostrictive element, said biasing element being magnetically biased to cause said magnetostrictive element to be mechanically resonant when exposed to said alternating field; and (c) detecting means for detecting said mechanical resonance of said magnetostrictive element.

22. A magnetomechanical electronic article surveillance system according to claim 21, wherein said magnetostrictive element comprises an alloy of iron, nickel, molybdenum and boron.

23. A magnetomechanical electronic article surveillance system according to claim 22, wherein said magnetostrictive element essentially has the composition $Fe_{40}Ni_{38}Mo_4B_{18}$.

24. A marker for use in a magnetomechanical electronic article surveillance system, comprising a discrete amorphous strip essentially having the composition $Fe_{40}Ni_{38}Mo_4B_{18}$, the marker having an overall thickness of less than 0.065 inches.

25. A marker according to claim 24, wherein the marker has an overall thickness of substantially 0.055 inches.

26. A marker according to claim 24, wherein the marker has an overall thickness of substantially 0.037 inches.

27. A method of reducing a degree of longitudinal curvature in an amorphous metal alloy strip having a longitudinal axis, the method comprising the steps of:

applying a curvature to the alloy strip along the longitudinal axis of the strip and at an orientation opposite to a longitudinal curvature exhibited by the strip prior to said application of curvature, said curvature being applied by wrapping said strip around a curved element; and heat-treating the strip at the curved element.

28. A method according to claim 27, wherein said amorphous metal alloy strip is a continuous ribbon and said heat-treating and curvature-applying steps are performed while transporting the alloy strip from a supply reel to a take-up reel.

29. A method according to claim 27, wherein the alloy strip comprises an alloy of iron, nickel, molybdenum and boron.

30. A method according to claim 29, wherein the alloy strip essentially has the composition $Fe_{40}Ni_{38}Mo_4B_{18}$.

31. A method of forming magnetostrictive elements for use in a magnetomechanical electronic article surveillance marker, comprising the steps of:

providing a continuous strip of an amorphous metal alloy;

continuously supplying the alloy strip to a heating location;

heat-treating the alloy strip at the heating location while continuously transporting the alloy strip in a curved path at the heating location; and cutting the heat-treated strip into discrete strips each having a predetermined length.

* * * * *

UNITED STATES PATENT AND TRADEMARK OFFICE

CERTIFICATE OF CORRECTION

PATENT NO. : 5,684,459

DATED : November 4, 1997

INVENTOR(S) : Liu et al.

It is certified that error appears in the above-identified patent and that said Letters Patent is hereby corrected as shown below:

Col. 1, line 49, delete "According" and insert -- According --. (New Paragraph)

Col. 4, line 43, delete "$B_{38}$" and insert -- $B_{18}$ --.

Col. 6, line 31, delete "1,385 inches" and insert -- 1.385 inches --.

Col. 9, line 65, delete "$B_{38}$" and insert -- $B_{18}$ --.

Signed and Sealed this

Twenty-first Day of March, 2000

*Attest:*

*Attesting Officer*

Q. TODD DICKINSON

*Commissioner of Patents and Trademarks*